United States Patent [19]

Johnson et al.

[11] Patent Number: 4,872,573

[45] Date of Patent: Oct. 10, 1989

[54] PLASTIC CLOSURE WITH BARRIER COATING

[75] Inventors: Marion Johnson, Baytown; Granville J. Hahn, Big Spring, both of Tex.

[73] Assignee: Permian Research Corporation, Big Spring, Tex.

[21] Appl. No.: 195,095

[22] Filed: May 17, 1988

Related U.S. Application Data

[63] Continuation-in-part of Ser. No. 922,127, Oct. 23, 1986, Pat. No. 4,744,478.

[51] Int. Cl.[4] ..... B65D 53/00

[52] U.S. Cl. ..... 215/347; 215/348; 215/316

[58] Field of Search ..... 215/316, 329, 341, 347, 215/348

[56] References Cited

U.S. PATENT DOCUMENTS

| | | | |
|---|---|---|---|
| 3,976,217 | 8/1976 | Dukess | 215/347 X |
| 4,347,939 | 9/1982 | Upton | 215/341 X |
| 4,640,428 | 2/1987 | Chang | 215/347 X |
| 4,723,678 | 2/1988 | Kollen et al. | 215/347 |
| 4,756,437 | 7/1988 | Rossi-Mossuti | 215/316 X |

*Primary Examiner*—Donald F. Norton

*Attorney, Agent, or Firm*—Ross, Howison, Clapp & Korn

[57] ABSTRACT

A moldable plastic closure comprising a selectively foamed, unitarily molded layer and at least one layer of barrier resin adapted to retard the migration of oxygen-containing gasses through the closure.

11 Claims, 2 Drawing Sheets

PLASTIC CLOSURE WITH BARRIER COATING

CROSS-REFERENCE TO RELATED APPLICATION

This application is a continuation-in-part of U.S. patent application Ser. No. 06/922,127, filed Oct. 23, 1986, issued May 17, 1988, as U.S. Pat. No. 4,744,478.

TECHNICAL FIELD

This invention relates to plastic closures, and more particularly, to plastic closures for glass or plastic containers used for the storage of beverages or food products. One aspect of the invention relates to a container closure comprising a unitarily molded, foamed polymeric sealing layer. Another aspect of the invention relates to a polymeric closure having a unitarily foamed layer that is formed in situ. Still another aspect of the invention relates to a polymeric closure having a barrier layer adapted to retard the passage of oxgen and carbon dioxide through the closure.

BACKGROUND OF THE INVENTION

Plastic container closures and, more particularly, plastic closures for carbonated beverage bottles having threaded necks are well known, having previously been disclosed, for example, in U.S. Pat. Nos. 4,310,101; 4,326,639; 4,394,918; 4,461,391; and 4,476,987. Such closures typically employ sealing discs and/or molded flanges which contact the bottle lip to reduce the loss of carbonation through the space between the closure and the bottle finish. Used alone, integrally molded plastic flanges have not provided the desired sealing characteristics. Although sealing discs have proved to be quite effective for reducing loss of carbonation, they are usually separately manufactured and then inserted into a molded bottle cap, thereby increasing both the time and expense required to produce a satisfactory closure. A unitarily molded plastic bottle cap having improved sealing characteristics is disclosed in U.S. Pat. No. 4,744,478.

Notwithstanding the advantages achieved with the moldable plastic closures having an integrally molded foam layer, manufacturers may require closures that are adapted to further retard the migration of oxygen or carbon dioxide through the closure without appreciably increasing thickness or weight of the closure. In other instances, manufacturers may desire lighter or thinner closures having an equivalent or better capability to retard oxygen or carbon dioxide migration.

The processes for making many plastic closures such as soft drink bottle caps, other bottle caps, jar lids and the like usually include injection molding of the basic lid, followed by installation of some sort of gasket material to provide a tight seal between the bottle finish and the cap or lid. When utilized in this manner, permeable gasket materials frequently do not adequately retard the migration of certain gasses, either resulting in loss of carbon dioxide (from soft drinks) or the infusion of oxygen (into food products and other beverages). In either instance, the quality of the product within the container may be significantly degraded or deteriorated.

Plastic closures are therefore needed that comprise at least one substantially unfoamed polymer layer integrally molded to at least one foamed layer of the same polymer, and further comprise a coating adapted to further retard the migration of oxygen and carbon dioxide through the closure. Alternatively, plastic closures without foamed layers are needed that employ one or more barrier layers to retard the migration of gasses such as oxygen and carbon dioxide through the closure.

SUMMARY OF THE INVENTION

According to the present invention, a closure is provided that comprises at least one substantially unfoamed polymer layer integrally molded to at least one foamed layer of the same polymer, and further comprises a barrier layer adapted to retard the migration of gasses such as oxygen and carbon dioxide through the closure.

According to one embodiment of the invention, a closure is provided that comprises integrally molded polymeric end and side walls, including at least one relatively less dense foamed layer of the same polymer that is formed in situ as part of the end wall, and further comprises a relatively thinner layer of barrier resin as another layer of the end wall of the closure to retard the migration of gasses such as oxygen and carbon dioxide through the wall.

According to a preferred embodiment of the invention, the resin used to form the barrier layer of the subject closure is selected from the group consisting of copolymers of ethylene and vinyl alcohol, and polyvinylidene chloride. Preferred methods for applying the subject resins to the closures of the invention are by spraying and dipping, although in some closures laminated films of the barrier resins can also be utilized.

BRIEF DESCRIPTION OF THE DRAWINGS

The plastic closure of the invention is further described and explained in reference to the following drawings wherein.

Like numerals are used to describe like parts in all figures of the drawings.

DETAILED DESCRIPTION OF THE PREFERRED EMBODIMENTS

Figure 1:
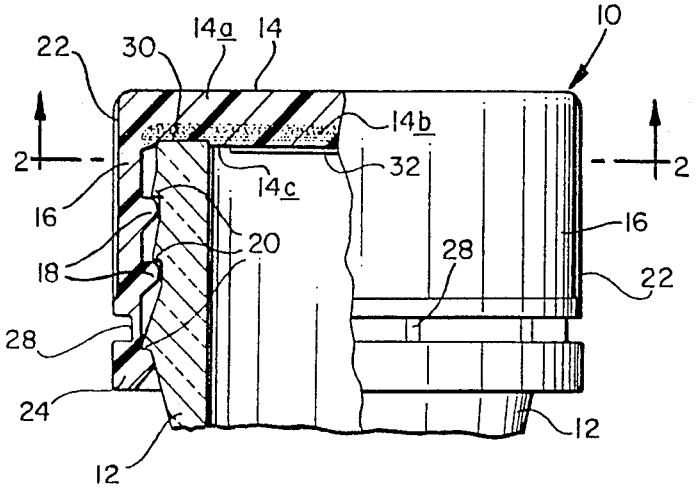
FIG. 1 is a front elevation view, partially in section, of the bottle cap of the invention applied to the neck of a bottle.

Referring to FIG. 1, bottle cap 10 is illustrative of a closure made in accordance with the present invention, and is depicted in threaded engagement with bottle neck 12. For ease of illustration, the remainder of the bottle is broken away. Similarly, in the left half of FIG. 1, a portion of bottle cap 10 and bottle neck 12 are broken away to depict a partial sectional view. Bottle caps made in accordance with the invention are successfully utilized with bottles made of either glass or plastic.

Bottle cap 10 preferably comprises circular end wall 14 and circumferentially extending side wall 16. End wall 14 preferably further comprises foamed polymer layer **14*b* sandwiched between two relatively denser layers 14*a*, 14*c* of the same polymer. Layer 14*a* is the primary structural layer of end wall 14 and is desirably molded together with side wall 16 to provide a strong, continuous closure capable of withstanding pressures characteristic of the pressures encountered in sealing carbonated beverage containers. According to a preferred embodiment, when threaded onto the neck of a container such as a PET bottle with a torque of about 20 inch-pounds, nominal 28 mm bottle caps 10** weighing about 2.8 grams and made according to the composition of the invention will desirably not leak when subjected to a pressure of 100 psi for one minute, and will desirably not blow off when subjected to a pressure of as much as 150 psi for a short period.

The inwardly facing surface of side wall 16 preferably further comprises molded threads 18 which engage threads 20 of bottle neck 12. A plurality of circumferentially spaced ribs 22 are optionally provided on the outwardly facing surface of side wall 16 to assist the consumer in gripping bottle cap 10, although it will be understood by those of skill in the art upon reading this disclosure that knurling or other surface texturing can similarly be imparted to the outwardly facing surface of side wall 16 during the molding process for that purpose.

To provide evidence of tampering, bottle cap 10 preferably further comprises pilfer ring 24, which engages shoulder 26 of bottle neck 12. Pilfer ring 24 is desirably molded together with end wall 14 and side wall 16 of bottle cap 10, and is connected to the lower portion of side wall 16 by a plurality of relatively narrow, circumferentially spaced thermoplastic bridges 28 that are adapted to fail in tension when side wall 16 is rotated so as to remove bottle cap 10 from bottle neck 12. It is understood of course that the configuration of pilfer ring 24 is not critical to use of the present invention, and numerous pilfer ring structures are presently in use and/or described in the prior art.

Referring again to end wall 14, foamed polymer layer **14*b* is desirably disposed between unfoamed layer 14*a*, which has a thickness comparable to that of side wall 16, and layer 14*c*, which comprises a relatively thin skin of unfoamed polymer. According to one embodiment of the invention, the thickness of unfoamed polymer layer 14*a* is about twice the thickness of unfoamed polymer layer 14*c*, and foamed polymer layer 14*b* is about twice the thickness of unfoamed polymer layer 14*a*. The overall thickness of end wall 14 preferably ranges up to about 0.6 cm, with a thickness of about 0.125 inches (0.32 cm) being most preferred for carbonated beverage bottle closures manufactured from polypropylene. It is understood, however, that the thickness of end wall 14 and its constituent layers 14*a*, 14*b*, 14*c* can vary depending on the polymeric resin used, the dimensions and geometry of the container, and the pressures which the closure must withstand during use. The structure of layers 14*a*, 14*b*, 14*c*** and the manner in which they cooperate in the subject closure are further described and explained in relation to the method by which the layers are made.

Bottle cap 10 preferably comprises a major portion of a moldable thermoplastic resin, and most preferably, a major portion of an impact grade copolymer of polypropylene. Impact grade plastics typically comprise a minor amount of rubber such as EPDM or SBR rubber that is copolymerized with the plastic to yield a product having better impact resistance.

A preferred formulation for use in molding bottle cap 10 is a composition comprising a copolymer of polypropylene and rubber, from about 1.25 to about 6 pphr (parts per hundred of resin) foam concentrate further comprising sodium bicarbonate and citric acid, from about 0.15 to about 1 pphr calcium carbonate, from about 0.03 to about 0.15 pphr amorphous silicon dioxide, from about 0.1 to about 0.4 pphr lubricant selected from the group consisting of synthetic waxes and distilled monoglycerides, from about 0.1 to about 0.4 pphr lubricant selected from the group consisting of N,N'-dioleoylethylenediamine and calcium stearoyl-2-lactylate, from about 0.15 to about 0.3 pphr unsaturated fatty monoamide, and from about 0.5 to about 2 pphr titanium dioxide concentrate.

Particularly referred polymeric resins for use in the composition are Shell Propylene Copolymer 7912S marketed by Shell Chemicals and El Paso 57S20V Polypropylene marketed by El Paso Products Company. Both resins have a melt flow in the range of from about 20 to about 22 and are modified by the addition of rubber to improve impact properties. When using El Paso 57S20V, the addition of from about 0.1 to about 0.25 pphr sodium benzoate is preferred to serve as a polymer crystal nucleator. The addition of sodium benzoate is not necessary when using Shell 7912S.

The composition preferably further comprises from about 1.25 to about 6 pphr, and most preferably about 3 pphr, of foam concentrate containing sodium bicarbonate and citric acid. A preferred foam concentrate for use in the composition is XMF 1570 H marketed by Nortech, a division of Enron Chemical Company. XMF 1570 H comprises 50% sodium bicarbonate/citric acid in a low density polyethylene base resin.

The formulation preferably further comprises from about 0.15 to about 1 pphr, and most preferably about 0.2 pphr, calcium carbonate. A preferred calcium carbonate for use in the formulation is Omyacarb UF marketed by Omya, Inc.

The formulation preferably further comprises from about 0.03 to about 0.15 pphr, and most preferably about 0.1 pphr, amorphous silicon dioxide. A preferred silica is Cab-O-Sil M-5 marketed by Cabot Corporation.

The formulation preferably further comprises from about 0.1 to about 0.4 pphr lubricant selected from the group consisting of synthetic waxes and distilled monoglycerides. A preferred synthetic wax is Acrawax C (prilled) marketed by Glyco Inc. About 0.2 pphr Acrawax C is preferably utilized in making the subject compositions. When a distilled monoglyceride is selected for use in the subject formulation, PATIONIC 901 marketed by Patco Designed Chemicals is preferred. According to one preferred formulation, about 0.1 pphr PATIONIC 901 is utilized in making the subject compositions.

The formulation preferably further comprises from about 0.1 to about 0.4 pphr lubricant selected from the group consisting of N,N'-dioleoylethylenediamine and calcium stearoyl-2-lactylate. A preferred N,N'-dioleoylethylenediamine is Glycolube VL (prilled) marketed by Glyco Inc. About 0.2 pphr Glycolube VL is preferably utilized in making the subject compositions. When calcium stearoyl-2-lactylate is selected for use in the compositions, PATIONIC 930 marketed by Patco Designed Chemicals is preferred. About 0.1 pphr PATIONIC 930 is preferably utilized in making the subject compositions.

The formulation preferably further comprises from about 0.15 to about 0.3 pphr, and most preferably about 0.25 pphr, unsaturated fatty monoamide. A preferred unsaturated fatty monoamide is Kemamide E fatty amide marketed by the Humko Chemical Division of Witco Chemical Corporation.

The formulation preferably further comprises from about 0.5 to about 2 pphr, and most preferably about 1 pphr, titanium dioxide concentrate. A preferred titanium dioxide concentrate is #3015D marketed by Southwest Chemical. While this material is preferred for use in a composition for making a white closure such as a bottle cap, it is understood that other similar pigments can also be utilized for making products of other colors. In addition to functioning as a pigment within the composition, it is believed that the titanium dioxide concentrate of the preferred embodiment also functions as a nucleator and lubricant.

To manufacture a closure such as a bottle cap utilizing the barrier coating of the invention, a masterbatch is desirably prepared in which the thermoplastic resin and other preferred additives are combined in a hopper and extruded together to obtain good dispersion of the additives throughout the thermoplastic melt. The extrudate is pelletized and stored until use. At the time of use, the masterbatch pellets are fed into the extruder section of an injection molding machine.

The mold tooling is preferably designed so that when the mold is initially closed, the space within the mold cavity approximately corresponds to the configuration of layers 14*a* and 14*c* of end wall 14, side wall 16, pilfer ring 24 and bridges 28 of bottle cap 10. This is advantageously accomplished with mold tooling comprising a mold core defining the interiorly facing walls and a mold cavity portion defining the outwardly facing walls of bottle cap 10. The core portion of the mold tooling is preferably further adapted by means of a retractable insert to slightly increase the volume of that portion of the mold cavity defining end wall 14 during the molding process. As the plastified resin begins to cool within the mold, the insert is retracted, thereby reducing the pressure within that portion of the mold corresponding to end wall 14 of bottle cap 10 sufficiently to permit the foaming agent to expand. As the insert retracts, the relatively cool boundary layer of resin abutting the retracting surface moves with it, forming layer 14*c* of end wall 14. Behind the boundary layer, the foam concentrate causes the thermoplastic resin to expand into the zone of reduced pressure, thereby forming individual cells of foamed polymer about the nucleator sites. Upon completion of cooling, these cells of foamed polymer define layer 14*b* of end wall 14. The relative thickness of layers 14*a*, 14*b* and 14*c* will therefore vary according to the polymer composition, the pressure within the mold cavity before and after retraction of the insert, the degree of cooling prior to and during retraction of the insert, and the distance the insert is retracted. Also, while the bottle cap disclosed herein is made through use of a retractable surface on the core side of the mold, it should also be understood that closures can also be made by utilizing retractable surfaces on the cavity side of the mold.

If the surface of the retractable insert is coextensive with the inwardly facing surface of layer 14*c* of bottle cap 10, layer 14*b* formed by the expansion of resin into the zone of reduced pressure will create a continuous layer of foamed polymer spanning the inside circumference of bottle cap 10. On the other hand, if the surface of the retractable insert is an annulus, layer 14*b* will comprise a circumferentially extending annular "donut" of foamed polymer separating layers 14*a* and 14*c* except in the central portion of end wall 14 of bottle cap 10.

Figure 3:
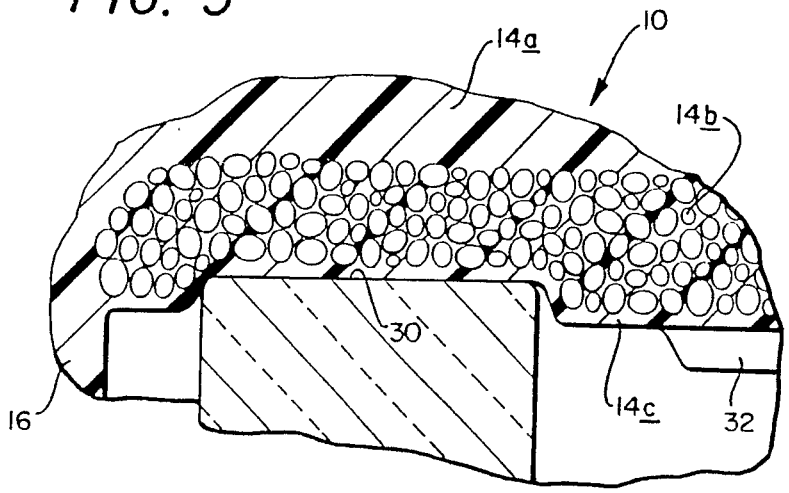
FIG. 3 is a detail view depicting an enlarged portion of the sectional view in FIG. 1 to better illustrate the foamed polymer layer of the invention and the line of contact between the bottle cap and the upwardly extending neck of a bottle to which the cap is attached.

Referring to FIGS. 1 and 3, it is seen that when bottle cap 10 is tightly applied to bottle neck 12, top edge 30 of bottle neck 12 exerts force against the surface of layer 14*c* adjacent thereto. This force causes the foamed polymer cells to compress behind that portion of layer 14*c* contacting top edge 30, which is evidenced in FIGS. 1 and 3 by the upward deflection of layer 14*c* adjacent to top edge 30. This effect provides a tight seal between bottle cap 10 and bottle neck 12 as desired.

Figure 2:
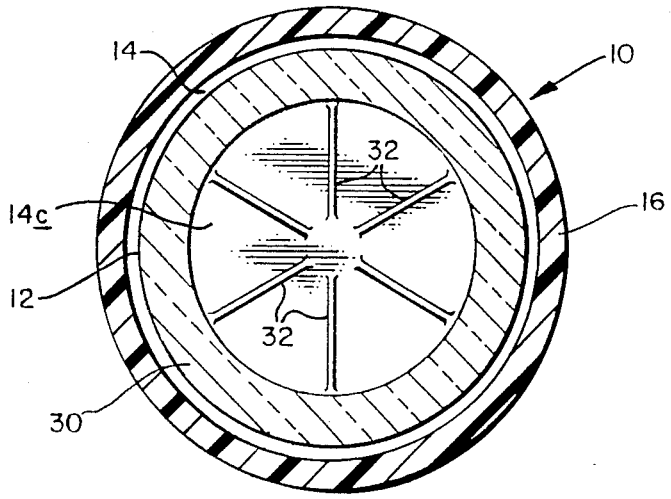
FIG. 2 is a sectional bottom plan view taken along line 2—2 of FIG. 1.

If desired, optional ribs 32 can be incorporated into layer 14*c* of end wall 14 as shown in FIGS. 1 and 2 by providing correspondingly shaped recesses in the face of the of the tool corresponding to the interiorly facing surface of layer 14*c*. Such ribs, which are shown emanating radially from near the center of layer 14*c* in FIG. 2, may assist in further strengthening end wall 14.

To avoid any appreciable foaming of the polymer in side wall 16 (including threads 18), pilfer ring 24 or bridges 28, it is emphasized that all surfaces of both the core and cavity halves of the injection molding tooling except the retractable insert remain locked in fixed relation to each other from the time polymer is first injected into the mold cavity until sufficient cooling has occurred to maintain the dimensional stability of those portions of bottle cap 10 outside the mold.

Figure 4:
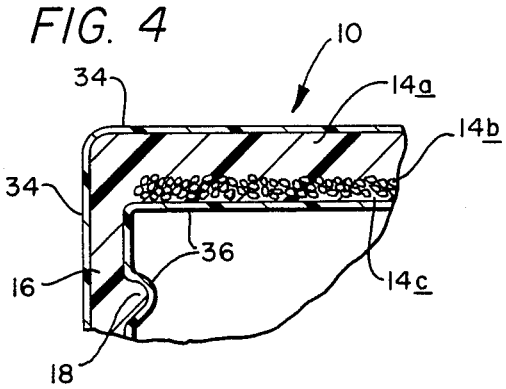
FIG. 4 is a sectional detail view depicting a portion of one of the subject closures wherein both the inwardly and outwardly facing surfaces of the closure comprise a layer of barrier resin.
Figure 5:
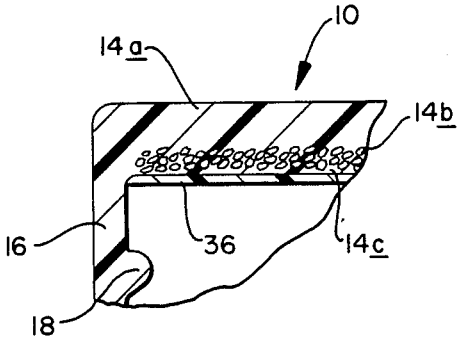
FIG. 5 is a sectional detail view depicting a portion of one of the subject closures wherein only the inwardly facing surface of the end wall comprises a layer of barrier resin.

Once a closure such as bottle cap 10 is formed as disclosed above, a layer or coating of barrier resin can be applied to the closure as depicted in, and described in relation to, FIGS. 4 and 5. Referring to FIG. 4, bottle cap 10 preferably further comprises outside layer 34 and inside layer 36 of a barrier resin that is more impervious to the passage of oxygen and carbon dioxide gas than the plastic resin used in making such a closure. A preferred barrier resin for use in layers 34, 36 of bottle cap 10 is an EVAL emulsion which can be applied to bottle cap 10 by dipping or spraying, followed by drying or curing as necessary for the particular barrier material and barrier layer thickness utilized. EVAL is a registered trademark for polymers marketed by EVAL Company of America that are produced by saponification of the reaction products of ethylene and vinyl acetate. The thickness of barrier layers 34, 36 can vary from about 10 microns up to about 0.4 mils or greater. Although better resistance to the migration of oxygen-containing gasses is generally achieved with thicker layers, the desirable thickness for a particular application will also depend upon the geometry, thickness and material of the closure, the substance contained, the amount of allowable migration, the cost of the barrier material, and the extent of drying or curing required.

Referring to FIG. 5, closures such as bottle cap 10 can also be made utilizing a single barrier layer 36. As shown in FIG. 5, single barrier layer 36 is disposed on the inwardly facing surface of bottle cap 10. Barrier layer 36 can be applied to bottle cap 10 by any available satisfactory method, but is preferably applied by spraying or otherwise coating the inside surface of bottle cap 10 with an emulsion of a barrier resin such as EVAL. In some closures laminated films of the barrier resins can also be utilized.

It will be understood and appreciated upon reading this disclosure that other moldable resins, including by way of example other polyolefins, styrenics, etc., can also be utilized in making the closures of the invention when paired with a compatible barrier resin. The barrier resin used to form the barrier layer of the subject closures is preferably selected from the group consisting of copolymers of ethylene and vinyl alcohol, and polyvinylidene chloride. However, other resins such as nitrile resins, PET, PAN, thermosetting polyesters, thermosetting epoxies, and the like can also be used under some circumstances as the material for use in barrier layers 34, 36.

According to one embodiment of the present invention, a closure is provided that comprises at least one substantially unfoamed polymer layer integrally molded to at least one foamed layer of the same polymer, and further comprises a barrier layer adapted to retard the migration of gasses such as oxygen and carbon dioxide through the closure.

According t another embodiment of the invention, a closure is provided that comprises integrally molded polymeric end and side walls, including at least one relatively less dense foamed layer of the same polymer that is formed in situ as part of the end wall, and further comprises a relatively thinner layer of barrier resin as another layer of the end wall of the closure to retard the migration of gasses such as oxygen and carbon dioxide through the wall.

Container closures such as the bottle caps of the preferred embodiment disclosed herein exhibit highly desirable strength-to-weight ratios and low bulk densities when compared to other unitarily molded polymeric closures. Depending upon the polymer compositions utilized, the geometry of the closure, and the molding apparatus and procedures, and the number, type and thickness of the layers of barrier material, closures can be produced that will satisfactorily confine either gaseous or liquid fluids within a container. While the closures of the invention have primarily been described herein as comprising both a unitarily molded, selectively foamed layer of polymeric resin and a barrier layer of a barrier material demonstrating greater impermeability to the passage of gasses such as oxygen and carbon dioxide, it will be appreciated upon reading the present disclosure that closures molded from unfoamed thermoplastic resins can also benefit from the use of barrier layers as described herein. Thus, for example, one or more barrier layers could be utilized in closures molded from unfoamed polyethylene or polystyrene to achieve greater impermeability to the migration of oxygen and/or carbon dioxide.

Other advantages of the subject closures and various alterations and modifications of the compositions disclosed herein will become apparent to those of ordinary skill in the art upon reading the present disclosure, and it is intended that the present invention be limited only by the broadest interpretation of the appended claims to which the inventor may be legally entitled.

What is claimed is:

1. A polymeric container closure molded from a single moldable polymeric composition, said closure comprising integrally molded polymeric end and side walls, said end wall further comprising a first layer having a density substantially the same as the density of said side wall and a second relatively less dense foamed layer that is formed in situ, said molded closure being further adapted to retard the migration of oxygen-containing gasses through said closure by the addition of at least one dissimilar polymeric barrier layer.

2. The closure of claim 1 wherein said barrier layer comprises a material selected from the group consisting of copolymers of ethylene and vinyl alcohol.

3. The closure of claim 1 wherein said barrier layer comprises polyvinylidene chloride.

4. The closure of claim 1 wherein said barrier layer comprises polyethylene terephthalate.

5. The closure of claim 1 wherein said barrier layer comprises a material selected from the group consisting of thermosetting resins.

6. The closure of claim 1 wherein the thickness of said barrier layer ranges between about 10 microns and about 0.4 mils.

7. The closure of claim 1 wherein at least one barrier layer is disposed on the inwardly facing surface of said closure.

8. The closure of claim 1 wherein at least one barrier layer is disposed on the outwardly facing surface of said closure.

9. The closure of claim 1 wherein said oxygen containing gas is selected from the group consisting of oxygen and carbon dioxide.

10. A bottle cap molded from a single polymeric composition, said closure comprising integrally molded polymeric end and side walls, said end wall further comprising a first layer having a density substantially the same as the density of said side wall and a second relatively less dense foamed layer that ia formed in situ.

11. The bottle cap of claim 10 wherein said bottle cap is further adapted to retard the migration of oxygen-containing gasses through said closure by the addition of at least one dissimilar polymeric barrier layer.

* * * * *